US005887970A

United States Patent [19]

Payne

[11] Patent Number: 5,887,970

[45] Date of Patent: Mar. 30, 1999

[54] SHUTTER SYSTEM FOR HIGH INTENSITY DISCHARGE LIGHTS

[75] Inventor: Stephen C. Payne, Louisville, Ky.

[73] Assignee: Payne-Sparkman Manufacturing, Inc., New Albany, Ind.

[21] Appl. No.: 704,302

[22] Filed: Oct. 15, 1996

[51] Int. Cl.[6] ..... F21V 17/02

[52] U.S. Cl. ..... 362/321; 362/263; 362/294

[58] Field of Search ..... 362/263, 280, 362/321, 294, 351

[56] References Cited

U.S. PATENT DOCUMENTS

| | | | |
|---|---|---|---|
| 537,918 | 4/1895 | Edwards | 362/321 |
| 1,178,292 | 4/1916 | Brandquist . | |
| 2,023,666 | 12/1935 | Courtright | 362/321 |
| 2,509,438 | 5/1950 | Kennelly | 362/321 |
| 2,531,924 | 11/1950 | Smyth | 362/263 |
| 4,490,776 | 12/1984 | Kluch | 362/16 |
| 4,505,522 | 3/1985 | Liljendahl | 160/121 |
| 4,874,026 | 10/1989 | Worral | 160/23 |
| 5,010,464 | 4/1991 | Kwang-sik et al. | 362/284 |
| 5,042,866 | 8/1991 | Cody | 296/97 |

*Primary Examiner*—Ira S. Lazarus
*Assistant Examiner*—David Lee
*Attorney, Agent, or Firm*—Scott R. Cox

[57] ABSTRACT

Disclosed is a shutter system for selectively blocking the path of light of a high intensity discharge lamp. The shutter system comprises a high intensity discharge lamp, a high intensity discharge light housing into which the lamp is secured and a shutter and light absorption system secured to the light housing comprising a light absorbing shutter screen, a screen moving system for moving the screen in front of the lamp to block selectively the path of light and for withdrawing the screen from the path of light and a support system for the screen moving system, wherein said screen when retracted will not significantly interfere with the path of light of the system and when fully extended will substantially block the path of light of the high intensity discharge lamp.

5 Claims, 1 Drawing Sheet

SHUTTER SYSTEM FOR HIGH INTENSITY DISCHARGE LIGHTS

BACKGROUND OF INVENTION

1. Field of Invention

This invention is a shutter system for blocking the path of light of a high intensity discharge lamp. More particularly, the invention is an adjustable shutter system which blocks the path of light of a high intensity discharge lamp while also absorbing light from the lamp and discharging heat created by the light away from the system.

2. Prior Art

In theater lighting or lighting for sporting events, it is often desirable to partially or totally block the path of light from spot lights to achieve varied lighting effects. Often during these events, it is also desirable to completely block the path of light and thereby create a darkened atmosphere for short periods of time. With some lighting systems, this effect is achieved by merely turning the lights off and back on. However, because of their structure and composition, it is difficult to turn off and quickly turn back on certain types of lighting, such as high intensity discharge lights. With this type of lighting source, once the system is turned off, there is generally a delay, sometimes of several minutes, to re-energize the system before it can be turned back on. Thus, it is undesirable to extinguish high intensity discharge lighting at any time during such an event. Other methods of blocking the path of light must then be used to achieve the desired darkened atmosphere.

Several systems currently exist which block the path of light of a light source. One system commonly used is an iris-type shutter system as shown, for example, in U.S. Pat. No. 4,458,303. Another type of shutter system uses a series of shutter blades which are extended or withdrawn from the path of light to block or partially block the path of light. By fully extending the blades, the path of light of the lighting system can be completely blocked. A number of these type of shutter systems are disclosed, for example, in U.S. Pat. Nos. 2,695,547, 4,210,955 and 5,510,969.

In addition to blocking the path of light, it is often desirable to defuse the light, thus changing its intensity or color. Light diffusing systems also often utilize a system of shutters that partially or totally block the path of light of a lighting system. See, for example, U.S. Pat. No. 4,052,607. In addition, U.S. Pat. No. 3,555,264 discloses a shutter system utilizing hinges which block portions of the light spectrum from escaping from a light source, such as white or infrared light.

A more complicated mechanical system for diffusing light is disclosed in U.S. Pat. No. 4,972,306. In this system a tambour-type panel of sections is attached to a track system. The panels are moved by this track system in front of the path of light. By blocking the path of light with different types of filter panels, the spectrum of the light which escapes the system is modified.

With lighting systems such as high intensity discharge lights, it is important not only to block the path of the light, but also to prevent heat buildup within the high intensity discharge light system while the path of light is being partially or totally blocked. Modern high intensity discharge lights operate at high temperatures, as high as 750° F. If a shutter system merely blocks the path of light of a high intensity discharge light, heat created by the lighting system is trapped within the system resulting in serious heat build up which reduces the effectiveness and life expectancy of the system. In addition, these high temperatures increase the likelihood of fire or other heat-related damage to the lighting system.

It is therefore an object of this invention to disclose a shutter system for use with a high intensity discharge lighting system.

It is a further object of this invention to disclose a shutter system for use with a high intensity discharge lighting system which substantially blocks the path of light from a high intensity discharge lighting system.

It is a still further object of this invention to disclose a motorized shutter system for use with a high intensity discharge lighting system which is capable of both blocking the discharge of light and permitting full discharge of light from the high intensity discharge light.

It is a still further object of this invention to disclose a lighting and shutter system which combines a motorized shutter system to prevent light from escaping the high intensity discharge light system with a heat absorbing cover which absorbs and discharges heat away from the light system.

These and other objects and features of the present invention will become apparent to those skilled in the art from consideration of the detailed description, drawings and claims. The description along with the accompanying drawings provides a selected example of construction of the device to illustrate the invention.

SUMMARY OF INVENTION

In accordance with the present invention there is described a lighting and shutter system for use with a high intensity discharge lamp comprising a high intensity discharge lamp system which discharges light substantially in a path of light, a high intensity discharge light housing to which the high intensity lamp system is secured, and a shutter and heat absorption system secured to the housing, wherein this shutter system comprises a light and heat absorbing screen and a moving means for moving the screen both in front of and away from the path of light of the lamp system, wherein said screen is capable of both blocking the path of light and at the same time absorbing and discharging heat created by the high intensity lighting system away from the system.

DETAILED DESCRIPTION OF INVENTION

Figure 1:
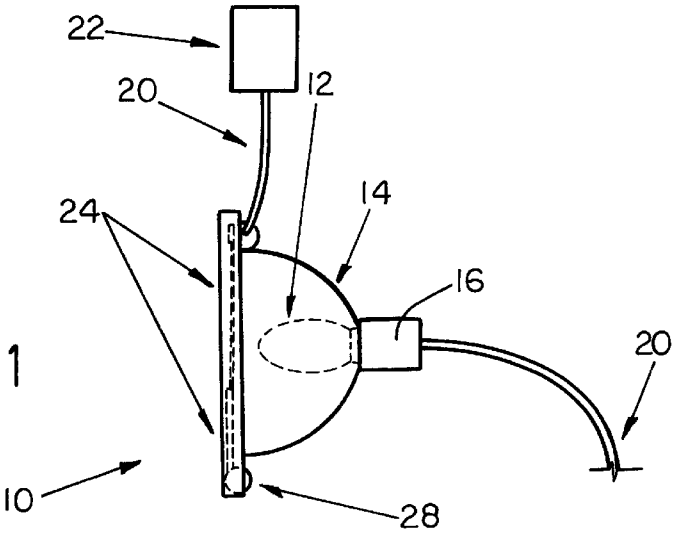
FIG. 1 is a side view showing the lighting and shutter system and its control system.

The lighting and shutter system (10) of the instant invention is designed for use with a high intensity discharge ("HID") lighting system. The components of a typical HID system include the HID lamp (12) or bulb and the HID lamp housing (14). The housing includes an outlet (16) for the HID lamp, a bowl-shaped structure (18) which reflects the light given off by the HID lamp and electrical wiring (20) and a control mechanism (22) which control the operation of the HID system. See FIG. 1. Such HID lamp and lamp housing are conventional and are obtained, for example, from General Electric Co. (lamp and housing) and North American Phillips (lamp and housing).

The HID lamp and lamp housing are secured to a shutter and support system. The shutter and support system comprises a screen system for partially or totally blocking the path of light emitted by the HID lamp and a screen support system (24) for supporting the screen system and securing it to the HID lamp housing (14). The critical element of the shutter system is a light and heat absorbing shutter screen (26). See FIG. 2. This screen (26) is preferably secured to the screen support system (24) in such a manner that it can be drawn across the path of the light of the HID lamp and also withdrawn from covering said path of light.

It is critical that the light and heat absorbing shutter screen (26) be manufactured from a material which not only blocks the path of light when it is drawn across the path of light, but also absorbs light emitted by the HID lamp, converts that light to heat and radiates a substantial portion of that heat away from the system. The light and heat absorbent screen (26) can be made from any material which is flexible, strong and durable so that it can be rolled upon a bar. In addition, the screen must absorb light, withstand the effect of the heat given off by the HID lamp, convert the light to heat and radiate the heat away from the system. In a preferred embodiment, the screen (26) is manufactured from a flexible, fiberglass material, such as a fiberglass cloth produced by Amatex. Other materials for use as a screen may include a graphite cloth or other such flexible materials that absorb heat without degradation and dissipate that heat away from the system. Using the proper material for the screen, such as fiberglass, upwards of 80 percent, and preferably about 90 percent of the heat is absorbed and dissipated by the screen away from the lamp housing. Typically, the HID lamp housing (14) which contains the HID lamp (12) are larger than about 1 foot in diameter. Thus, the screen (26) should be at least about 1 foot wide to fully block the path of light of the HID lamp when the screen (26) is fully drawn across the path of light.

Figure 2:
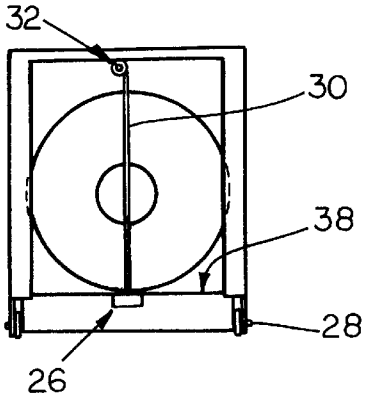
FIG. 2 is a front view of the system looking into the fixture with the shutter screen fully retracted.

In a preferred embodiment, the light and heat absorbing screen (26) is secured to a spring loaded bar (28) located at one side of the shutter support system. As shown in FIG. 2 in its retracted position, the screen (26) is rolled up onto the spring loaded bar (28). In a preferred embodiment the spring loaded bar (28) is a roller-type bar manufactured by Fabtech. It is secured to the lamp housing by conventional means such as bushings at each end.

Figure 3:
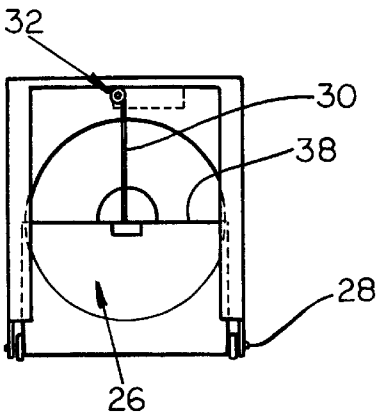
FIG. 3 is a front view with the shutter screen partially retracted.

Because the spring loaded bar (28) contains springs which encourage it to a fully wound, closed position, the screen (26) will normally be rolled up onto the spring loaded bar (28). However, the screen is also designed to be drawn in front of the HID lamp (12) to block its path of light. See FIG. 3 where the screen is partially extended. To extend the screen to block the path of light, one edge (38) of the screen is preferably secured to a cable (30) which runs across the HID lamp housing and is itself secured to a sheave or pulley wheel (32) secured to the opposite side of the housing from the spring loaded bar (28). The pulley (32) is secured to the lamp housing by means of a conventional gearbox shaft. In a preferred embodiment the pulley wheel (32) is about 2 inches in diameter, manufactured by Fabtech.

Figure 4:
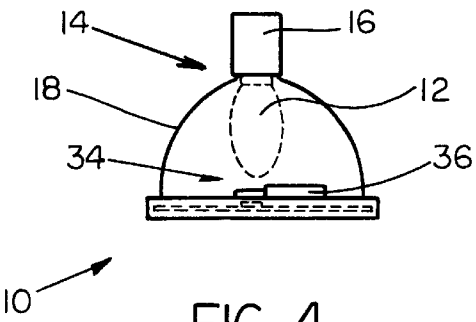
FIG. 4 is a side view showing the lighting system with motor and gear box.

The cable (30) is secured to the pulley wheel (32) such that as the pulley rotates, it pulls the cable (30), thus drawing the screen (26) across the path of light of the HID lamp (12). Secured to the pulley (32) is a means for winding the cable onto the pulley. Preferably, this is a conventional gear box (34) secured to a conventional motor (36). See FIG. 4. Although any conventional gear box (34) and motor (36) can be used which accomplishes the goals of the invention, in a preferred embodiment, the gear box and motor is a D.C. actuator manufactured by ITT.

When the motor (36) is activated, it pulls the cable (30) around the pulley wheel (32), thus pulling the screen (26) across the front of the lamp of the lighting and support system (10). The motor (36) must also be reversible, such that upon reversing direction, the pulley will rotate in the opposite direction. When this opposite rotation occurs, the cable (30) is discharged from the pulley (32). Because the screen is wound around a spring loaded bar (28), it will then automatically unwind as the cable (30) is released from the pulley (32), thus uncovering the path of light of the HID lamp.

By operation of the motor, the screen (26) can be either drawn in front of the HID lamp (12) or it can be fully retracted, so that it does not block the path of light. Obviously partial blockage of the path of light of the HID system is also possible with this system. See, for example, FIG. 3. When a number of these lights are installed in a gymnasium or auditorium, each of the motors is preferably electrical integrated with an electrical control box so that all motors may be coordinated as needed to an opened, closed or partially opened position. Such control box is conventional as is well known in the industry.

By this system, blocking the path of light of the HID lighting system can be achieved without turning the lamp off. While the light is blocked, heat created by the system is partially absorbed by the screen (26) and radiated at a lower temperature away from the screen. By this system heat generated by the HID lamp (12) is dissipated away from the lamp, reducing the likelihood of fire or other damage to the HID system (10). When the screen is fully withdrawn, the path of light is unblocked, permitting full discharge of light from the HID lamp.

I claim:

1. A lighting and shutter system comprising (a) a high intensity discharge lamp which emits light into a path of light, (b) a high intensity discharge lamp housing into which the lamp is secured, and (c) a shutter and light absorption system secured to the lamp housing comprising a flexible light absorbing shutter screen, wherein the flexible screen absorbs at least about 80 percent of heat generated by the high intensity discharge lighting when the flexible screen is fully extended, a moving system for moving the flexible screen in front of the lamp to block the path of light and for withdrawing the flexible screen from blocking the path of light, wherein said flexible screen when retracted will not significantly interfere with the path of light and when fully extended will substantially block the path of light and a support system for the moving system.

2. The lighting and shutter system of claim 1 wherein the flexible screen is produced from fiberglass.

3. The lighting and shutter system of claim 1 wherein the moving system for moving the flexible screen comprises a motor and a cable secured to the flexible screen for extending the flexible screen and a spring loaded bar which interacts with the cable to retract the flexible screen.

4. A lighting and shutter system comprising (a) a high intensity discharge lamp which emits light into a path of light, (b) a high intensity discharge lamp housing into which the lamp is secured, and (c) a shutter and light absorption system secured to the lamp housing comprising a flexible light absorbing shutter screen, wherein the flexible screen is produced from fiberglass, a moving system for moving the flexible screen in front of the lamp to block the path of light and for withdrawing the flexible screen from blocking the path of light, wherein said flexible screen when retracted will not significantly interfere with the path of light and when fully extended will substantially block the path of light and a support system for the moving system.

5. The lighting and shutter system of claim 4 wherein the moving system for moving the flexible screen comprises a motor and a cable secured to the flexible screen for extending the flexible screen and a spring loaded bar which interacts with the cable to retract the flexible screen.

* * * * *